US006145832A

United States Patent [19]

Saito et al.

[11] Patent Number: 6,145,832

[45] Date of Patent: Nov. 14, 2000

[54] IMAGE FORMING APPARATUS

[75] Inventors: Yasuhide Saito; Hidekazu Amamoto, both of Saitama, Japan

[73] Assignee: Fuji Xerox Co., Ltd., Tokyo, Japan

[21] Appl. No.: 09/149,140

[22] Filed: Sep. 8, 1998

[30] Foreign Application Priority Data

Sep. 8, 1997 [JP] Japan ..... 9-242716

[51] Int. Cl.[7] ..... B65H 1/00

[52] U.S. Cl. ..... 271/162; 271/164

[58] Field of Search ..... 271/9.11, 9.13, 271/3.14, 4.01, 162, 164

[56] References Cited

U.S. PATENT DOCUMENTS 4,966,356 10/1990 Ohyabu et al. ..... 271/164 X
5,002,266 3/1991 Kikuchi et al. ..... 271/164 X
5,413,409 5/1995 Arai ..... 271/162 X

FOREIGN PATENT DOCUMENTS 4-70836 6/1992 Japan .
4-256642 9/1992 Japan .
8-314355 11/1996 Japan .
9-110195 4/1997 Japan .

*Primary Examiner*—David H. Bollinger
*Attorney, Agent, or Firm*—Finnegan, Henderson, Farabow, Garrett & Dunner, L.L.P.

[57] ABSTRACT

In an image forming apparatus, at least a part of a transporting passage for guiding a recording sheet of paper to an image forming unit is opened from the front side of an apparatus body. According to the image forming apparatus, a paper jam can be easily removed and a space necessary for maintenance/inspection such as removal of the paper jam can be minimized.

18 Claims, 7 Drawing Sheets

21

IMAGE FORMING APPARATUS

BACKGROUND OF THE INVENTION

1. Field of the Invention

The present invention relates to an image forming apparatus such as a printer, copier, facsimile, etc. and more particularly to an image forming apparatus which can easily remove a jammed sheet of paper (hereinafter referred to as "jammed sheet") at a sheet feeding unit where a paper jam is likely to occur and can minimize a space necessary for maintenance such as removal of a jammed sheet.

2. Description of the Related Art

FIG. 1 is a conceptual sectional view showing a main part of a conventional image forming apparatus 1 such as a printer, copier, facsimile, etc., particularly having a sheet feeding device 2 with a removable tray accommodating sheets therein.

In the sheet feeding device 2 of such a conventional image forming apparatus 1, sheets P and Q stacked on cassette plates (not shown) within trays 3 and 4 arranged at upper and lower stages are urged upward by springs arranged on the lower sides of the trays plates respectively so that they are forced into contact with sheet feeding roles 5 and 6 each having a sectional crescent shape, respectively.

The sheet P arranged within the trays 3 at the upper stage is pulled out from the trays 3 in accordance with the rotation of the sheet feeding roll 5, is guided along a chute 7 as indicated by arrow A and transported to an image forming unit 9 of an electrostatic recording type including a photoreceptor drum 8.

Incidentally, the trays 3 and 4 are accommodated within supporting boxes 10 and 11, respectively. At the time of maintenance/inspection such as filling of sheets of paper P and Q, these trays 3 and 4 can be pulled out from the supporting boxes 10 and 11, respectively, in a direction perpendicular to the paper face of the drawing.

Such a sheet feeding device 2 is disclosed in e.g. Japanese Utility Model Unexamined Publication No. Hei. 4-70836.

In the sheet feeding device 2, a sheet guiding passage 13 is formed between the shute 7 and a wall 12 constituting a part of a box-shaped apparatus body.

The sheet Q pulled out from the tray 4 at the lower stage by the sheet feeding roll 6 is transported upward to the image forming unit 9 as indicated by arrow B through a chute 14 and the passage 13.

In the conventional image forming apparatus 1, when a sheet Q is jammed in the sheet guiding passage 13, i.e. when a paper jam occurs, the sheet feeding tray 4 at the lower stage is detached from the supporting box 11 to remove the sheet Q. In this case, the chute 14 and sheet feeding roll 6 hinders an operator's hand from reaching the jammed sheet. This makes it difficult to remove the sheet Q having caused the paper jam from the passage 13.

This problem can be solved by an image forming apparatus disclosed in Japanese Patent Unexamined Publication No. Hei. 4-256642.

In the image forming apparatus disclosed in Japanese Patent Unexamined Publication No. Hei. 4-256642, another chute which constitutes a sheet guiding passage in cooperation with a member corresponding to the above chute 14, i.e. a portion corresponding to the wall 12 in FIG. 1 is tilted toward the rear side of the sheet feeding device 2 as indicated by arrow C to open the passage 13.

Therefore, when a paper jam occurs, by opening the chute (i.e. portion corresponding to the wall 12 in FIG. 1), the jammed sheet can be easily removed.

However, the conventional image forming apparatus in which the one chute constituting the sheet guiding passage is movable has still the following problem.

Generally, for easy attaching/detaching, the tray is attached from the front of the body of the image forming apparatus while the movable chute for opening the sheet guiding passage is arranged on the rear side of the image forming apparatus.

In this case, at the time of maintenance/inspection such as removal of a paper jam, in order that the movable chute can be tilted, a space enough to tilt the chute must be assured on the rear side of the image forming apparatus. In addition, a further space must be preferably assured so that an operator can enter the rear side to work facing the rear of the image forming apparatus.

Thus, each of the conventional image forming apparatus has a disadvantage that the space which is not generally required must be assured around the image forming apparatus in preparation against abnormality such as occurrence of a paper jam.

In recent years, the image forming apparatus such as a printer is required to have a performance of downsizing, i.e. promotion of space saving as well as miniaturizing. From such a point of view, it may be out of the question that the conventional image forming apparatus described above requires the space on the rear side of the apparatus for the purpose of removing the paper jam.

As a result, each of the conventional image forming apparatus as described above can realize miniaturizing of its own size, but cannot still reduce the space necessary for its installation from the viewpoint of assuring the space necessary for maintenance/inspection such as removal of a paper jam.

SUMMARY OF THE INVENTION

Under such a circumstance, it is an object of the present invention to provide an image forming apparatus which can easily remove a paper jam and minimize the space necessary for maintenance/inspection such as removal of the paper jam.

In order to achieve the above object, the present invention provides an image forming apparatus comprising: an apparatus body; an image forming unit, provided on the apparatus body, for forming an image on a recording sheet of paper transported; a tray sheet feeding unit, provided on an upstream side of the image forming unit in a direction of transporting the recording sheet of paper, for accommodating stacked recording sheets of paper, the tray sheet feeding unit being installed removably from a front side of the apparatus body; and a transporting passage for guiding the recording sheet of paper fed from a direction of mounting the tray sheet feeding unit to the image forming unit, wherein at least a part of a chute surface constituting the transporting passage is moved from an attaching/detaching side of the tray sheet feeding unit so that at least a part of the transporting passage is opened from the front side of the apparatus body.

Thus, the sheet jammed in the apparatus body can be easily removed, and also the space of installing the image forming apparatus necessary for maintenance/inspection such as removal of a paper jam can be reduced.

Further, the present invention provides an image forming apparatus comprising: an apparatus body; an image forming unit, provided on the apparatus body, for forming an image on a recording sheet of paper transported; a recording sheet accommodating unit, provided on an upstream side of the image forming unit, for placing stacked recording sheets of paper through a prescribed space in the apparatus body from outside the apparatus body; a sheet feeding unit, provided on a further upstream side of the recording sheet accommodating unit in a direction of transporting the recording sheets, for accommodating stacked recording sheets of paper, the sheet feeding unit being provided detachably from the apparatus body; a transporting passage for guiding the recording sheet of paper fed from the sheet feeding unit to the image forming unit; and a part of the transporting passage formed in the recording sheet accommodating unit, wherein the recording sheet accommodating unit is moved so that at least a part of the transporting passage is opened though a prescribed space of the apparatus body.

Furthermore, the present invention provides a unit which is installed removably from an apparatus body, the unit comprising: a recording sheet accommodating section on which stacked recording sheets of paper are placed; a driven section provided in the vicinity of the recording sheet accommodating section; and driving force transmitting means for transmitting a driving force from the apparatus body to the driven section, wherein the unit is installed in a manner that at least front end portions of the recording sheets placed on the recording sheet accommodating section in a sheet feeding direction are positioned within the apparatus body.

Thus, the maintenance/inspection operation of the recording sheet accommodating section, driven section and driving force transmitting means provided in the unit can be performed very easily. Further, even if the unit is required to be recycled, such a requirement can be satisfied easily due to the structure as a unit.

DETAILED DESCRIPTION OF THE PREFERRED EMBODIMENTS

A description will be given of one embodiment of the image forming apparatus according to the present invention.

Figure 1:
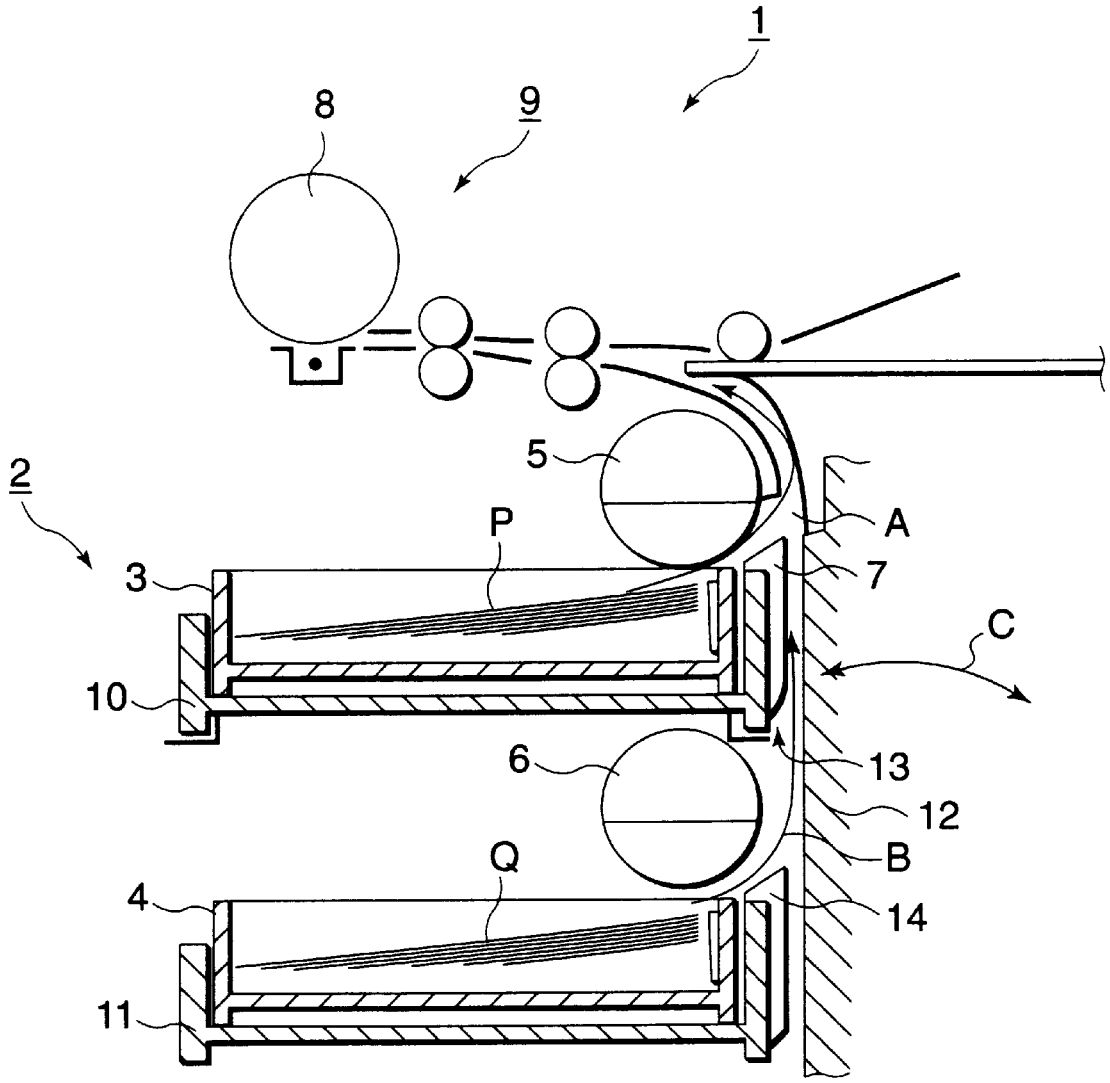
FIG.1 PRIOR ART
FIG. 1 is a conceptual view of the main part of a conventional image forming apparatus.
Figure 2:
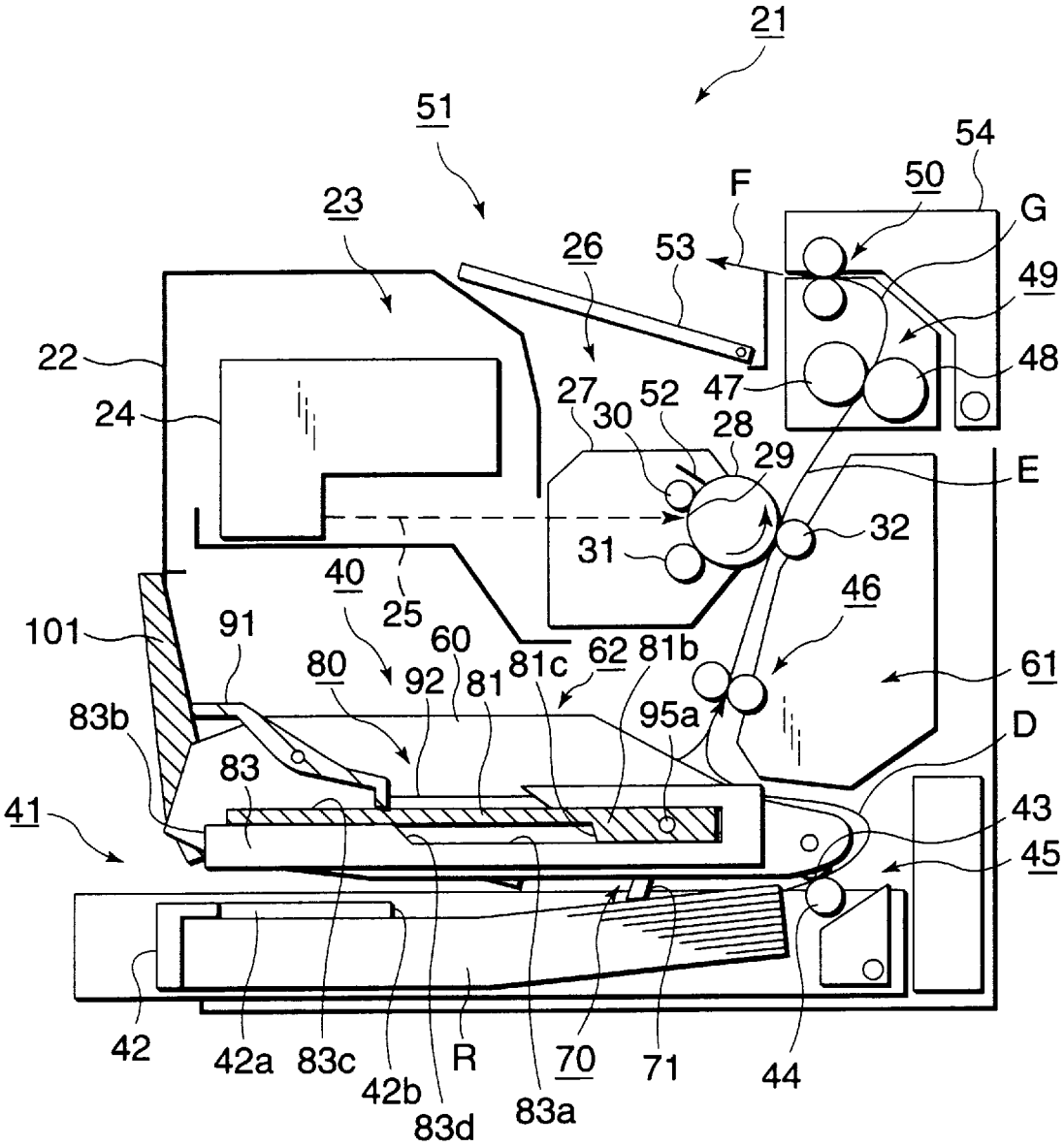
FIG. 2 is a conceptual view of an image forming apparatus according to the present invention.

FIG. 2 is a conceptual view of a laser beam printer 21 which is an image forming apparatus according to the present invention.

In this laser beam printer 21, at an upper position within a box-shaped apparatus body 22, a light exposure device constituting a part of an image forming unit 23, i.e. a laser scanning device 24 is arranged. A laser beam 25 containing image information emitted from the laser scanning device 24 repeatedly scans an exposure position 29 on the surface of a photoreceptor drum 28 accommodated within a process cartridge 27 constituting a developing unit 26, in an axial direction, i.e. a main scanning direction.

The above image forming unit 23 includes the laser scanning device 24 which is an exposure device, the process cartridge 27 constituting the developing unit 26, and a resist roll 46 which will be described later.

On the other hand, at an slightly upstream position from the light exposure position 29, a charge roll 30 is arranged in opposition to the photoreceptor drum 28 so as to charge the surface of the photoreceptor drum 28 uniformly.

When the photoreceptor drum 28 after having been charged is irradiated with the laser beam 25 described above, an electrostatic latent image corresponding to image information is formed on the surface of the photoreceptor drum 28.

The latent image thus formed is developed at a downstream position from the exposure position 29 on the surface of the photoreceptor drum 28 by a developing roll 31.

The toner image obtained by developing moves to the position opposite to a transfer roll 32 by rotation of the photoreceptor drum 28 and electrostatically transferred to a recording sheet of paper (ordinary paper) described below.

Recording sheets onto each of which the toner image is transferred are stacked within a sheet accommodating unit 40 which is arranged below the apparatus body 22 and at the upstream side in a direction of transporting a recording sheet with respect to the image forming unit 23. The stacked sheets are placed into the recording sheet accommodating unit 40 through a space within the apparatus body 22. The recording sheets of paper are also stacked within a tray sheet feeding unit 41 which is arranged on the further upstream side in the direction of transporting the recording sheet with respect to the image forming unit 23 and is constructed by a removable tray 42 which can slide leftward in the drawing, i.e. toward the front side of the apparatus body 22.

Of these recording sheets, the recording sheets R stacked within the tray 42 are fed out one by one at prescribed timings from the uppermost position of the tray 42 by a sheet feeding roll (semicircular roll) not shown and described later.

The recording sheets thus fed out are transported along a transporting passage D indicated by solid line by a sheet transporting roll 45 composed of a pair of driving and following rolls 43 and 44. The transportation of the recording sheets is temporarily stopped when the tip of the sheet reaches a resist roll 46 located at a downstream position from the transporting roll 45. The following roll 44 of the sheet transporting roll 45 is urged toward the side of the driving roll 43 by means of an urging means such as a spring (not shown).

On the other hand, when the recording sheet is temporarily stopped by the resist roll 46, an electromagnetic clutch (not shown), which operates in synchronism with the rotary position of the photoreceptor drum 28, turns on. Then, the resist roll 46 starts to rotate so that the transportation of the recording sheet having temporarily stopped is started again at a constant and stable speed.

Further, the recording sheet passes at a prescribed timing between the photoreceptor drum 28 and transfer roll 32. At this time of passage, the toner image is transferred from the photoreceptor drum 28 onto the recording sheet. The recording sheet subjected to transfer is electricity-removed by an electricity removal needle (not shown) arranged on the downstream side of the transfer roll 32, and separated from the surface of the photoreceptor drum 28.

The recording sheet thus separated is transported over a transporting passage E having a prescribed distance to release its strain, and thereafter transported to a fixing device 49 composed of a pair of a heat roll 47 and a pressure roll 48. The toner image transferred onto the recording sheet is heat-fixed. The recording sheet after fixing is exhausted, as indicated by arrow F, onto an exhaust tray 51, which is an exhaust unit formed on the upper surface of the apparatus body 22, by a pair of exhaust rolls 50.

The toner image not transferred on the recording sheet is removed from the surface of the photoreceptor drum 28 by a cleaning device 52 arranged on the further downstream side of the transfer roll 32.

Incidentally, in FIG. 2, reference numeral 53 designates a bottom cover for opening/closing the bottom of the exhaust tray 51, and reference numeral 54 designates a cover for opening/closing a sheet transporting passage G between the fixing device 49 and the exhaust roll 50.

Next, a detailed description will be given of the sheet accommodating unit 40.

Figure 3:
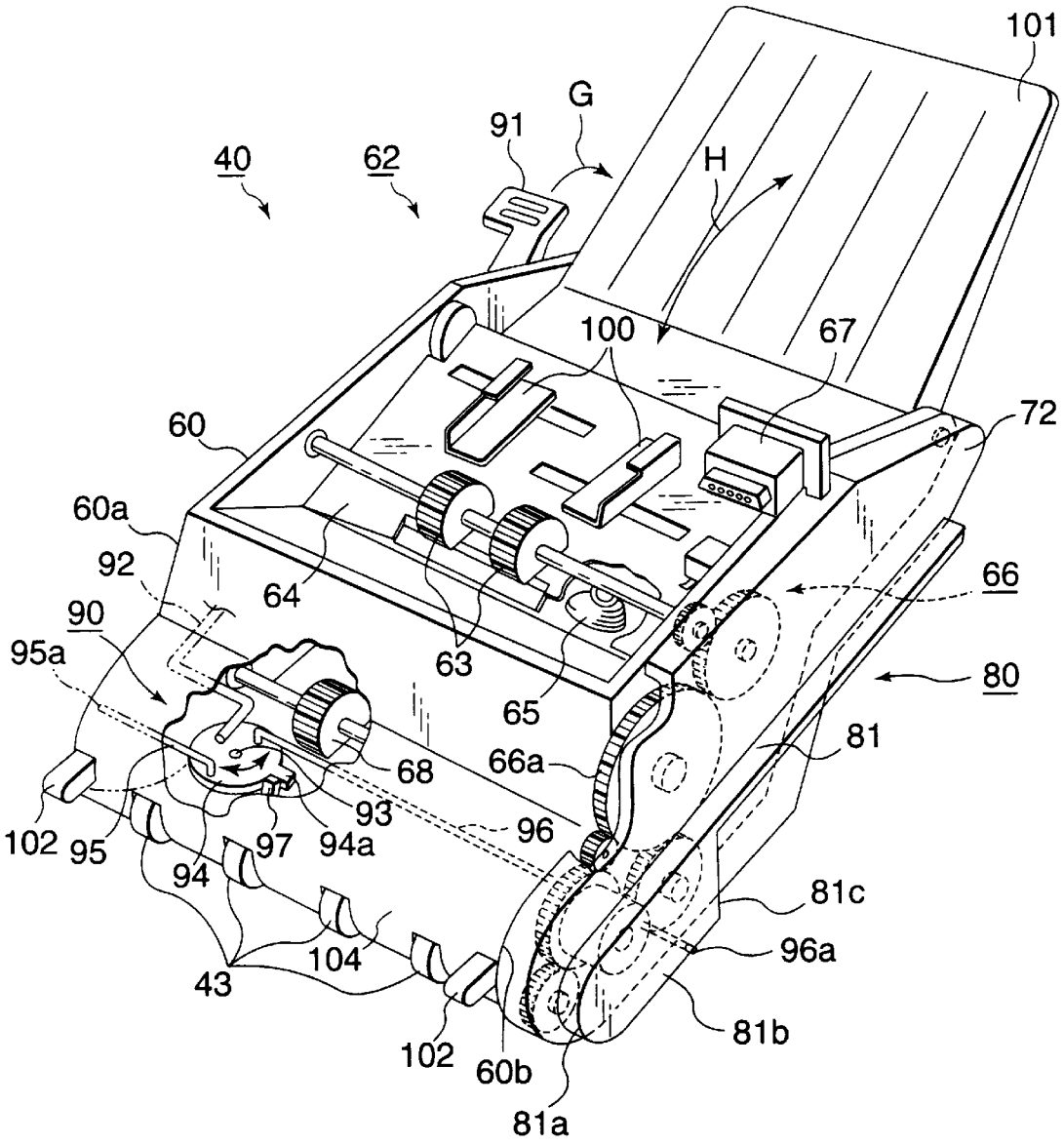
FIG. 3 is a conceptual perspective view of the main part of an image forming apparatus according to the present invention.

FIG. 3 is a conceptual perspective view of the recording sheet accommodating unit 40 with its main part exploded.

The sheet accommodating unit 40 is arranged within an enclosure 60 for stack/accommodation of the recording sheets so as to be integrated with the sheet transporting means 61 from the tray 42 to the image forming unit 23 in FIG. 2, more specifically, the transporting means 61 in the embodiment from the tray 42 to the resist roll 32 constituting a part of the image forming unit 23. Thus, the sheet accommodating unit 40 and the sheet transporting means 61 constitute a monolithic sheet accommodation/transportation unit 62.

The sheet accommodation/transportation unit 62 is slidably mounted in the same direction (toward the left side of the drawing, i.e. front side of the apparatus body 22) as the tray 42 with respect to the apparatus body 22 shown in FIG. 2.

On the other hand, as shown in FIG. 3, on the upper side of the enclosure 60 constituting the sheet accommodation/transportation unit 62 are arranged a body sheet feeding roll 63 for one-by-one separating/feeding the recording sheets stacked and accommodated in the enclosure 60, a sheet feeding plate 64, a spring 65 for urging the sheet feeding plate 64 toward the sheet feeding roll 63, etc. At the right end of the enclosure 60, a driving force transmitting device 66 is arranged which is composed of a series of gear wheels for transmitting the driving force from a body driving unit not shown (driving means such as a motor not shown arranged within the apparatus body 22 in FIG. 2) to respective elements (inclusive of the body sheet feeding roll 63) of the transporting means 61 installed within the enclosure 60. Additionally, when the sheet accommodation/transportation unit 62 is mounted in the apparatus body 22 as shown in FIG. 2, a pinion of the driving motor constituting the body driving unit not shown is engaged with a first following wheel gear 66*a* of the driving force transmitting device 66 shown in FIG. 3 so that the driving force is transmitted to each of the following wheel gears constituting the gear wheel transmitting device 66. Thus, the transporting means 61 is driven.

As shown in FIG. 3, at an upper position of the enclosure 60, a connector member 67 is arranged which serves to relay the driving power and electric signal supplied from the apparatus body 22 shown in FIG. 2. When the sheet accommodation/transportation unit 62 is mounted within the apparatus body 22 shown in FIG. 2, a plug arranged at a prescribed position within the apparatus body 22 is fitted in the connector member 67 so that they are electrically connected to each other.

As shown in FIG. 3, at a lower position of the enclosure 60, in addition to the body sheet feeding roll 63 which is an main component of the transporting means 61 (FIG. 2), are arranged a tray sheet feeding roll 68 which is also a main component of the transporting means 61, and the driving rolls 43 (FIG. 3) of the sheet transporting rolls 45 for transporting the sheets one-by-one separated from the tray 42 in FIG. 2 (the other following rolls are arranged within the apparatus body 22).

Incidentally, in the embodiment described above, the transporting means 61 from the tray 42 to the resist roll 46 of the image forming unit 23 in FIG. 2 includes the body sheet feeding roll 63, tray sheet feeding roll 68 and driving roll 43 as shown in FIG. 3.

Further, at various prescribed positions within the enclosure 60 are arranged various kinds of sheet sensors (not shown) for controlling the respective components of the transporting means 61. These various sensors include a detecting means 70 for detecting the presence or absence or remaining amount of the sheets R accommodated within the tray 42 in a manner of being brought into contact with the recording sheets or a piece moving with reduction thereof. A detecting lever 71 of the detecting means 70 is protruded from the lower face of the enclosure 60 toward the tray 42.

As shown in FIG. 3, , a side cover 72 covering the gear wheel transmitting device 66 is secured to the right side of the enclosure 60. On the side of the side cover 72 and left side 60*a* of the enclosure 60, a pair of guide projections having the same structure are protruded, which serve as one component of the guiding means 80 for slidably mounting the sheet accommodation/transportation unit 62 into the apparatus body 22 on the left side of the drawing (FIG. 2). Incidentally, it should be noted that the guiding projection 81 protruded from the left side 60*a* of the enclosure 60 is not shown in FIG. 3.

Each of the guide projections 81 which serve as the one component of the guide means 80 is extended in a longitudinal direction of the enclosure 60 and has a wide area 81*b* at its tip 81*a* having a larger width than the remaining area. The wide area 81*b* has a step portion 81*c* at its rear, which constitutes one of a stopper described later.

On the other hand, as shown in FIG. 2, a pair of guide plates 83 which serve as the other component of the guide means 80 and have the same structure are secured to both inner sides of the apparatus body 22.

It should be noted that in FIG. 2, only one of the pair of guide plates 83 is shown.

The guide plate 83 includes a guide groove 83 having a prescribed length and serving to guide the wide area 81*b* of the guide projection 81 in its longitudinal direction and a horizontal area 83*c* formed at the tip 83*b* of the guide plate 83 and serving to guide the other portion than the wide area 81*b* of the guide projection 81 slidably.

The guide groove 83*a* has a step portion 83*d* formed at its tip and on the way to the horizontal area 83*c*. The step portion 83*d* servers as the other component of the stopper. The step portion 83*d* is located at the position substantially opposite to the tip 42*b* of the cassette cover 42 which covers the upper face of the tray 42.

Thus, as shown in FIG. 2, the enclosure 60 of the sheet accommodation/transportation unit 62 can be slidably supported in the apparatus body 22 in such a manner that the pair of guide projections 81 protruded from both sides of the enclosure 60 are installed on the corresponding guide grooves 83*a* and horizontal areas 83*c* of the guide plates 83. The sliding movement of the enclosure 60 can be temporarily stopped when the step portions 81*c* of the guide projections 81 and the step portions 83*d* of the guide plates 83 are brought into contact with each other.

As shown in FIG. 3, within the enclosure 60, a latch means 90 is arranged for positioning and locking the sheet accommodation/transportation unit 62 when it is mounted at a prescribed position within the apparatus body 22 of FIG. 2.

The latch means 90 is composed of a latch lever 91 supported rotatably on the left side 60*a* of the enclosure 60, a linkage arm 92 for converting the rotation of the latch lever 91 into the to-and-fro movement of the enclosure 60, a rotary plate 94 engaged with the tip of the linkage arm 92 and rotating on a shaft 93 supported by the enclosure 60 in synchronism with the to-and-fro movement of the linkage arm 92, a lock pin 95 with one end engaged with the rotary plate 94 and the other end 95*a* capable of going from or into the left end 60*a* of the enclosure 60, and another lock pin 96 with one end engaged with the rotary plate 94 and the other end 96*a* capable of passing the right side 60*b* of the enclosure 60 and side cover 72 and of going from and into the side cover 72.

Additionally, the shaft 93 supporting the rotary plate 94 is wound by a torsion spring (not shown) for rotating the rotary plate 94 unidirectionally. The rotary plate 94 is provided with a protrusion 94*a* protruding from its outer periphery. By contact of this protrusion 94*a* with a stopper 97, the rotation of the rotary plate 94 exceeding a prescribed rotating angle is limited.

The latch means 90 operates as follows. When the latch lever 91 is rotated in a direction as indicated by arrow G, the lock pins 95 and 96 sink in the enclosure 60 through the linkage arm 92 and rotary plate 94. On the other hand, when the rotation indicated by arrow G of the latch lever 91 is released, because of the urging force of the torsion spring (not shown), the pair of lock pins 95 and 96 protrude from the right side 60*b* of the enclosure 60 and the side cover 72 through the rotary plate 94.

At prescribed positions of both inner side walls of the apparatus body 22 shown in FIG. 2, engagement holes are formed which are to be engaged with the respective tips 95*a* and 96*a* of the lock pins 95 and 96. When these tips 95*a* and 96*a* of the lock pins 95 and 96 are fit in the engagement holes, the enclosure 60, hence the sheet accommodating unit 40 is positioned and locked at a prescribed position of the apparatus body 22. When the latch lever 91 of the latch means 90 shown in FIG. 3 is rotated as indicated by arrow G to release the coupling between the tips 95*a*, 96*a* and the engagement holes, the sheet accommodating unit 40 becomes slidable leftward in FIG. 2 (front side of the apparatus body 22).

As described above, by providing the latch means 90 for latching the sheet accommodating unit 40 at the prescribed position within the apparatus body 22, when a recording sheet placed on the sheet accommodating unit 40 is fed out, it does not skew but can be transported accurately to the image forming unit 23. In addition, the nipping pressure of the transporting means 61 can be made uniform so that the recording sheet fed out from the sheet accommodating unit 40 or tray sheet feeding unit 41 can be transported with no skew.

Incidentally, in FIG. 3, reference numeral 100 designates a sheet width varying device arranged slidably along the sheet feeding plate 64; reference numeral 101 designates a sheet guide operable in a direction indicated by arrow H; and reference numeral 102 designates positioning protrusions for positioning/supporting the tip of the sheet accommodation/transportation unit 62 for the apparatus body 22 of FIG. 2. The positioning protrusions are to be fitted into positioning grooves (not shown) formed in the apparatus body 22 of FIG. 2 and positioned/supported there.

In FIG. 3, reference numeral 104 designates a chute for sheet guiding which is formed by a peripheral surface of the enclosure 60 in the neighborhood of the following rolls 43 constituting the sheet accommodating unit 40. The chute 104 serves as a part of the transporting passage D indicated by an arrow of FIG. 2.

Next, a description will be given of the operation of the sheet accommodating unit 40 constructed by the sheet accommodation/transportation unit 62.

Figure 4:
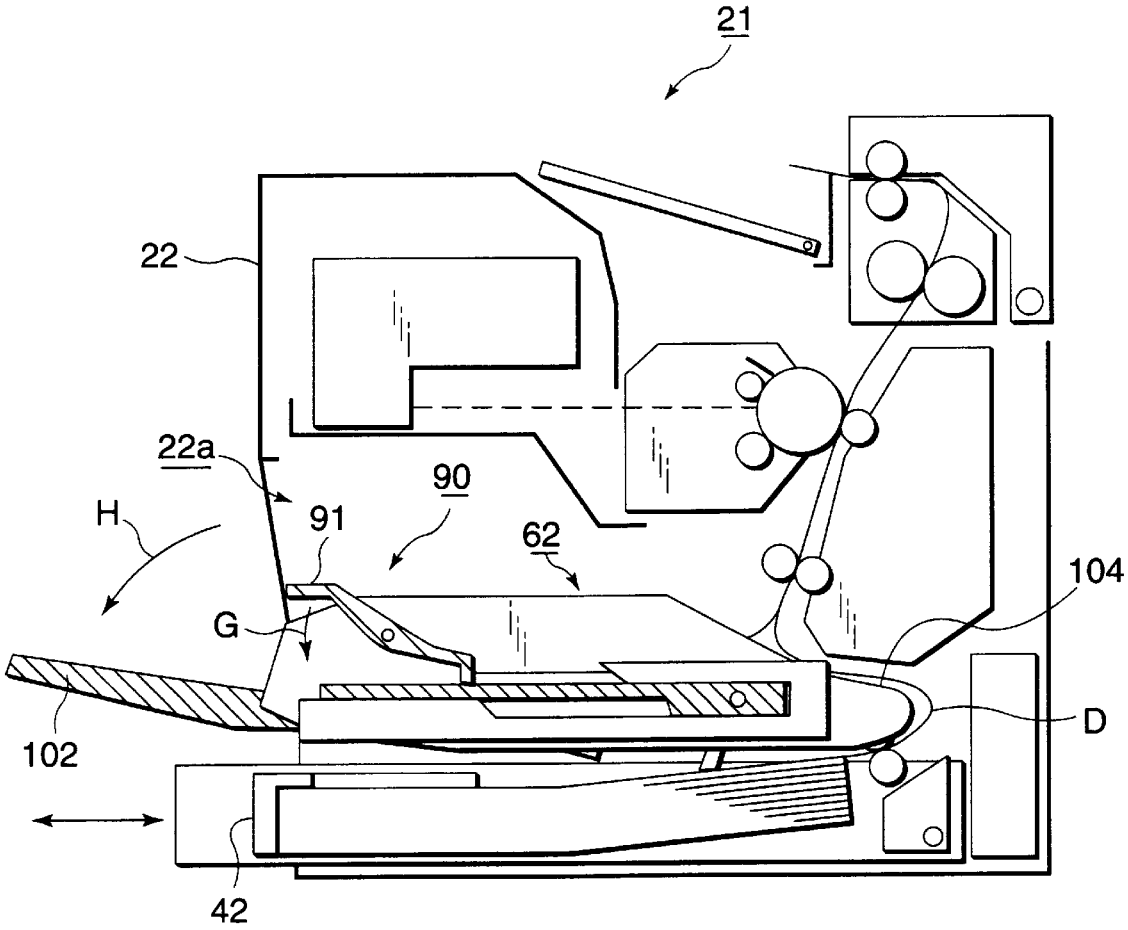
FIG. 4 is a conceptual view showing the operation of the image forming apparatus according to the present invention.

At the time of maintenance/inspection such as sheet supply, as shown in FIG. 4 in which like reference numerals refer to like parts in FIGS. 2 and 3, first, the sheet guide 102 is opened as indicated by arrow H to open the front of the apparatus body 22, i.e., a maintenance/inspection opening 22*a* which is a space formed on the one side in the attaching/detaching direction of the tray 42.

Next, the latch lever 91 of the latch means 90 is operated as indicated by arrow G to release the positioning/locking of the sheet accommodation/inspection unit 62 for the apparatus body 22.

Figure 5:
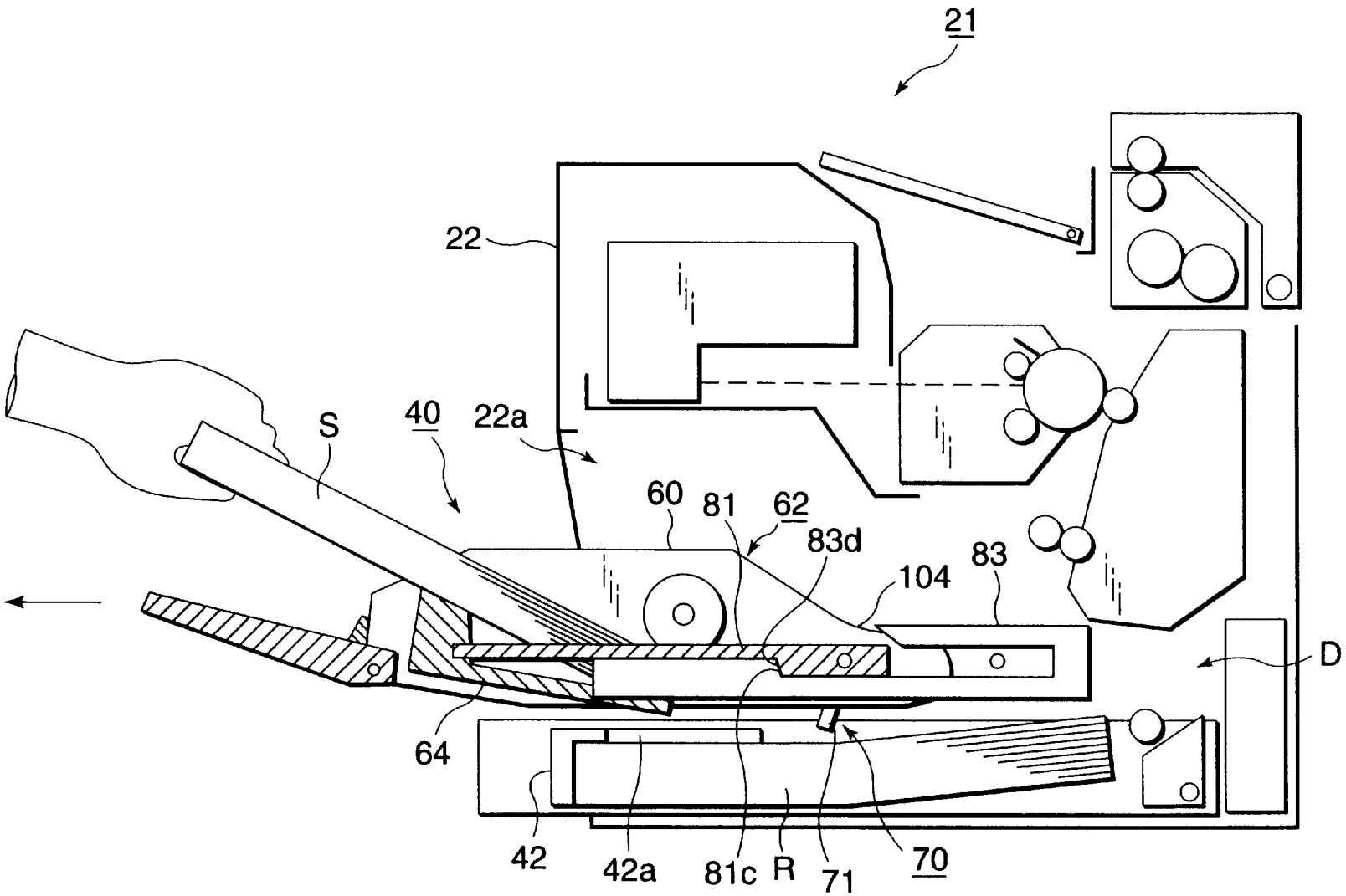
FIG. 5 is a conceptual view showing the operation of the image forming apparatus according to the present invention.

Then, as shown in FIG. 5, the sheet accommodation/transportation unit 62 serving as the sheet accommodating unit 40 is pulled out as indicated by arrow along the guide plates 83 from the maintenance/inspection opening 22*a* of the apparatus body 22. It should be noted that when the sheet accommodation/transportation unit 62 is pulled out, the step portions 81*c* of the guide projections 81 and the step portions 83*d* of the guide plates 83, which serve as the stopper means, are brought into contact with each other so that the sheet accommodation/transportation unit 62 cannot be further pulled out, thereby limiting the pulling-out exceeding a prescribed distance.

More specifically, as described above, since the detecting lever 71 of the detecting means 70 for detecting the presence or absence of the sheets R accommodated in the tray 42 is protruded from the lower surface of the enclosure 60 constituting the sheet accommodation/transportation unit 62, the sheet accommodation/transportation unit 62 can be pulled out to the position where the detecting lever 71 is not in contact with the other member that is the tray cover 42*a* in the embodiment. As shown in FIG. 5, by pulling out the sheet accommodation/transportation unit 62 along the guide plates 83 by a prescribed distance, an operator can easily supply recording sheets S stacked on the sheet feeding plate 64.

The sheet accommodation/transportation unit 62 can be housed into the apparatus body 22 by the operation reverse to the operation described above.

Accordingly, as described above, since the stopper means for limiting the movement of the sheet accommodating unit 40 at the prescribed position is provided in the apparatus body 22, at the time of sheet supply into the sheet accommodating unit 40, the sheet accommodating unit 40 is not excessively slid so that the sheet accommodating unit 40 or the sheets placed thereon are not fallen, thereby permitting safety of the apparatus to be assured.

Figure 6:
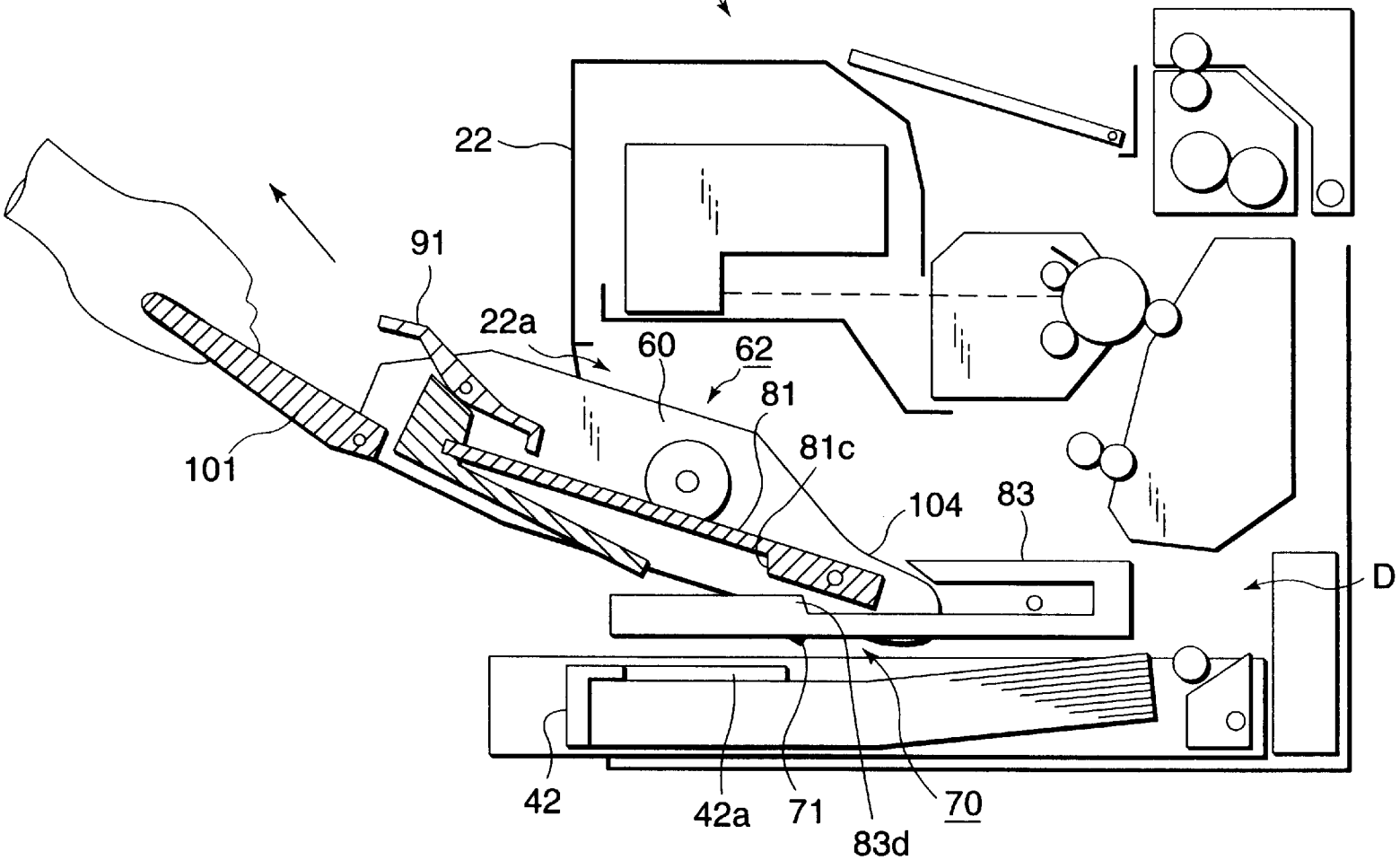
FIG. 6 is a conceptual view showing the operation of the image forming apparatus according to the present invention.

On the other hand, it is now assumed that a paper jam has occurred at a portion of the transporting means 61 shown in FIG. 2. In removing the sheet that is a cause of the paper jam, as shown in FIG. 6, the sheet accommodation/transportation unit 62 is moved in a slanting upward direction as indicated by arrow from its position in FIG. 5 so that it is pulled out while releasing the contact between the step portions 83*d* of the guide plates 83 and the step portions 81*c* of the guide protrusions 81.

In this way, when the sheet accommodation/transportation unit 62 is moved in a slanting upward direction to release the contact between the step portions 83*d* of the guide plates 83 and the step portions 81*c* of the guide protrusions 81, the entire sheet accommodation/transportation unit 62 can be taken out from the maintenance/inspection opening 22*a* of the apparatus body 22 while collision is avoided between the detecting lever 71 of the detecting means 70 protruding from the lower face of the enclosure 60 constituting the sheet accommodating unit 40 and the tray cover 42*a*. This prevents the detecting lever 71 from being damaged.

Figure 7:
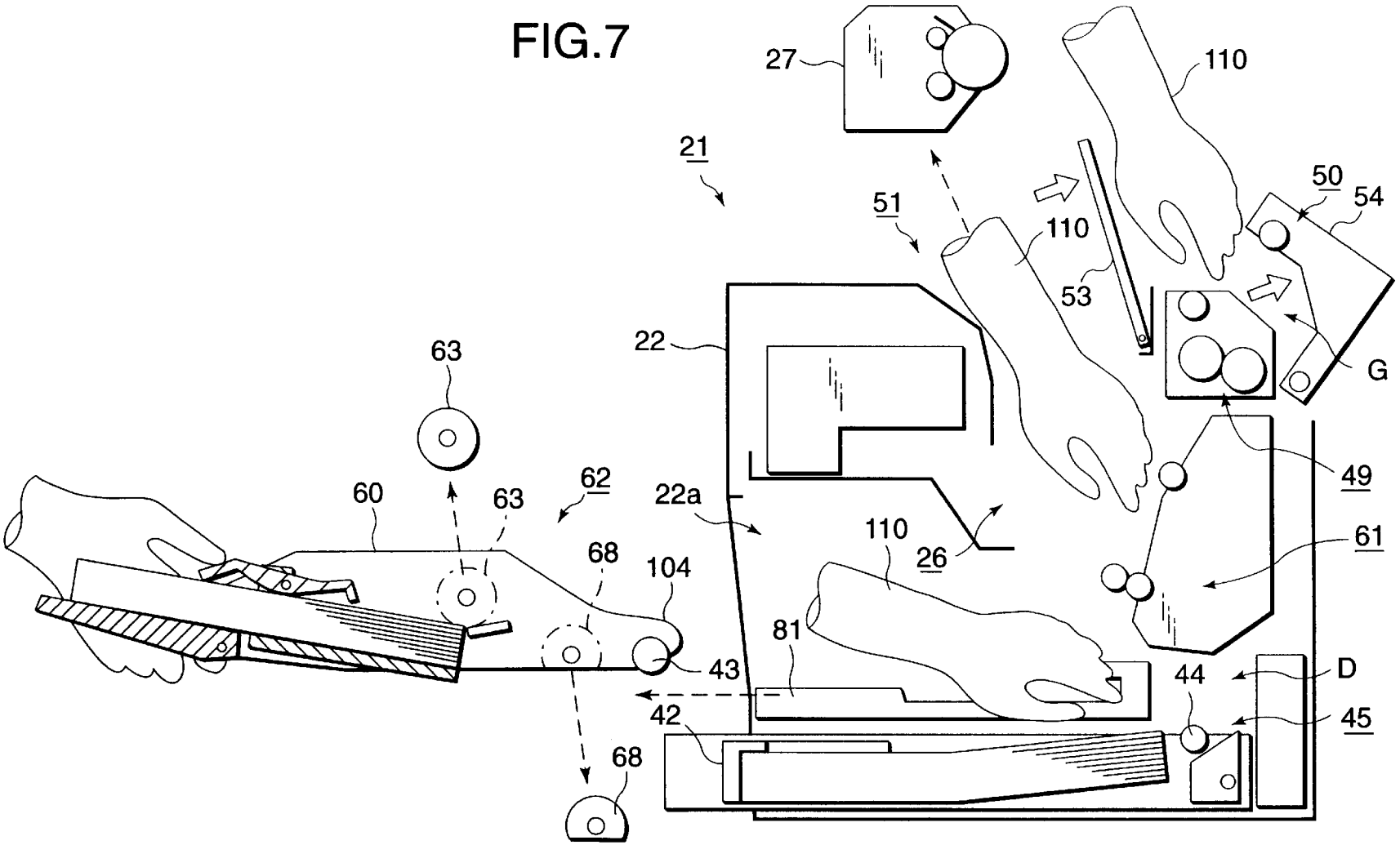
FIG. 7 is a conceptual view showing the operation of the image forming apparatus according to the present invention.

Thereafter, if the entire sheet accommodation/transportation unit 62 is detached from the apparatus body 22 as shown in FIG. 7, the chute 104 constituting a part of the transporting passage D (FIG. 2) as well as the enclosure 60 is also removed. Therefore, an operator's hand 110 can be easily inserted into the transporting passage D through a prescribed space at the front side of the apparatus body 22, i.e. maintenance/inspection opening 22*a*. In addition, the operator can visually check the transporting passage and hence can easily take out a sheet jammed in the vicinity of the sheet transporting roll 45.

Namely, in the image forming apparatus described above, even when the sheet is jammed between the tray-type sheet feeding unit 41 and the image forming unit 23, the paper jam can be easily removed from the front side of the apparatus body 22, thereby improving the operability of the apparatus. Further, by moving the sheet accommodating unit 40, the paper jam can be easily removed from the same side as that of placing the recording sheets on the sheet accommodating unit 40, thereby improving the operability of the apparatus.

Since the sheet accommodating unit 40 is moved slidably toward the same side as that of placing the sheets thereon, the paper jam can be not only easily removed, but also stacked sheets of paper difficult to handle, such as a sheet having a large size, thin sheet, etc. can be easily placed within the sheet accommodating unit 40.

Further, if the stacked sheets are placed in the sheet accommodating unit 40 on the same side as that of pulling out the tray sheet feeding unit 41, all the handling operations relative to feeding sheets of paper, such as supply of sheets of paper, removal of the paper jam, can be carried out on the same side, thereby improving the operability of the apparatus.

Thereafter, if the sheet accommodation/transportation unit 62 serving as the recording sheet accommodating unit 40 is completely detached from the apparatus body 22, maintenance/inspection operation such as cleaning, exchange, etc. of the body sheet feeding roll 63, tray sheet feeding roll 68 and driving roll 43 can be easily performed. In addition, the shaft members for the body sheet feeding roll 63, tray sheet feeding roll 68 and driving roll 43 and wheel bearings for supporting these shaft members can be easily attached or detached. Thus, the maintenance/inspection such as exchange of the solenoid or electromagnetic clutch (not shown), which serves to take electrical timings of the driving force transmitting means 66 or the respective rolls, can be further easily performed.

Further, as shown in FIG. 7, the paper jam in the vicinity of the developing unit 26 can be easily removed by opening the bottom cover 53 for opening/closing the bottom of the exhaust tray 51 which is a sheet exhausting unit to remove the process cartridge 27 constituting the image forming unit 23 upward of the apparatus body 22. Further, the sheet jammed in the sheet transporting passage G between the fixing device 49 and the exhausting roll 50 can be easily removed by opening the cover 54 serving as a cover of the fixing device.

The image forming apparatus described above is designed in such a manner that detaching/attaching of the image forming unit 23, exhaust of the recording sheet, placing of the stacked sheets on the recording sheet accommodating unit 40 and pulling-out of the tray sheet feeding unit 41 are carried out on the front side of the apparatus body 22. Therefore, all the respective operations inclusive of the maintenance/inspection can be performed on and from the front side of the apparatus body 22, thereby greatly improving the operability of the image forming apparatus. Further, on the rear and lateral sides of the apparatus body 22, provision of any special mechanism for jam removal is not required. The area for installing the apparatus body 22 has only to be assured so that the space necessary to install the image forming apparatus can be minimized.

Incidentally, in this embodiment, as shown in FIG. 2, the sheet accommodation/transportation unit 62 is configured so that the transporting means 61 from the tray sheet feeding unit 41 to the image forming unit 23 is arranged integrally to the sheet accommodation/transportation unit 62 serving as the sheet accommodating unit 40. However, the present invention should not be limited to such a configuration of the sheet accommodation/transportation unit. The transporting means from the tray sheet feeding unit 41 to the sheet accommodating unit 40, i.e. the tray sheet feeding roll 68 and driving rolls 43 shown in FIG. 3 may be installed integrally to the enclosure 60 serving as the sheet accommodating unit 40 to constitute the sheet accommodation/transportation unit while the other transporting means, i.e. the body sheet feeding roll 63 shown in FIG. 3 may be installed on the side of the apparatus body 22 as in the conventional apparatus. In this case also, if the sheet accommodating unit 40 with the sheet accommodation/transportation unit in which the tray sheet feeding roll 68 and driving rolls 43 installed integrally to the enclosure 60 is pulled out from the front side of the apparatus body 22, the sheet jammed in the vicinity of the sheet transporting roll 45 can be easily taken out.

As another embodiment, the transporting means from the sheet accommodating unit 40 to the image forming unit 23, i.e. the body sheet feeding roll 63 shown in FIG. 3 may be installed integrally to the enclosure 60 to constitute the sheet accommodation/transportation unit while the other transporting means, i.e. the tray sheet feeding roll 68 and driving rolls 43 shown in FIG. 3 may be installed on the side of the apparatus body 22 as in the conventional apparatus. In this case also, if the sheet accommodating unit 40 with the sheet accommodation/transportation unit in which the body sheet feeding roll 63 is installed integrally to the enclosure 60 is pulled out from the front side of the apparatus body 22, the sheet jammed in the vicinity of the body sheet feeding roll 63 can be easily taken out.

As described above, according to the present invention, by opening at least a part of the transporting passage from the front side of the apparatus body, the maintenance/inspection operation such as removal of the sheet jammed in the apparatus body, exchange of sheet feeding and transporting rolls constituting the transporting means and setting of sheets in the sheet accommodating unit can be performed very easily. This remarkably improves the maintenance capability of the image forming apparatus.

Further, according to the present invention, the maintenance/inspection operation can be carried out from the one side of the image forming apparatus, i.e. from the front side of the image forming apparatus which is the same as the sheet feeding side. For this reason, the range of selecting the place where the image forming apparatus is to be installed by a user can be largely extended so that the space for maintenance/inspection of the image forming apparatus can be minimized.

What is claimed is:

1. An image forming apparatus comprising:

an apparatus body;

an image forming unit, provided on said apparatus body, for forming an image on a recording sheet of paper transported;

a tray sheet feeding unit, provided on an upstream side of said image forming unit in a direction of transporting the recording sheet of paper, for accommodating stacked recording sheets of paper, said tray sheet feeding unit being installed removably from a front side of said apparatus body; and a transporting passage for guiding the recording sheet of paper fed from a direction of mounting said tray sheet feeding unit to said image unit, wherein at least a part of a chute surface constituting said transporting passage is movable from an attaching/detaching side of said tray sheet feeding unit so that at least a part of said transporting passage is opened from the front side of said apparatus body.

2. The image forming apparatus according to claim 1, wherein said apparatus body further includes a recording sheet accommodating unit provided on an upstream side of said image forming unit in a direction of transporting the recording sheet, where stacked recording sheets of paper are placed through a prescribed space in said apparatus body from outside said apparatus body and a part of a peripheral surface of said recording sheet accommodating unit constitutes at least a part of the chute surface constituting said transporting passage.

3. The image forming apparatus according to claim 2, wherein said recording sheet accommodating unit is slidably movable on the same side as that of placing stacked recording sheets through a prescribed space in said apparatus body from outside said apparatus body.

4. The image forming apparatus according to claim 2, wherein the side of placing stacked recording sheets is the same as that of attaching/detaching said tray sheet feeding unit to said apparatus body.

5. The image forming apparatus according to claim 2, wherein said apparatus body further includes a sheet exhaust unit for exhausting a recording sheet containing an image formed by said image forming unit externally from said apparatus body; said image forming unit is provided removably from said apparatus body; and detaching/attaching of said image forming unit, exhaust of the recording sheet, placing of the stacked recording sheets on said recording sheet accommodating unit and attaching/detaching of the tray sheet feeding unit is carried out on the front side of said apparatus body.

6. The image forming apparatus according to claim 2, wherein said apparatus body includes means for transporting the recording sheets accommodated in said recording sheet accommodating unit and said tray sheet feeding unit to said image forming unit, and at least a part of said transporting means is slidably movable together with said recording sheet accommodating unit.

7. The image forming apparatus according to claim 2, wherein latching means for latching said recording sheet accommodating unit at a prescribed position of said apparatus body is provided between said apparatus body and said recording sheet accommodating unit.

8. The image forming apparatus according to claim 3, wherein said apparatus body includes a stopper for limiting slidable movement of said recording sheet accommodating unit to a prescribed position to which said recording sheet accommodating unit is pulled out.

9. The image forming apparatus according to claim 3, wherein said apparatus body includes a stopper for limiting slidable movement of said recording sheet accommodating unit to a prescribed position to which said recording sheet accommodating unit is pulled out, and said recording sheet accommodating unit includes detecting means for detecting presence or absence or remaining amount of the recording sheets in said tray sheet feeding unit in a manner of being brought into contact with the recording sheets or a piece moving with reduction of the amount of the recording sheets, and said detecting means is provided at a position where it is in contact with only the recording sheets or the piece while slidable movement of said recording sheet accommodating unit is limited by said stopper.

10. An image forming apparatus comprising:

an apparatus body;

an image forming unit, provided on said apparatus body, for forming an image on a recording sheet of paper transported;

a recording sheet accommodating unit, provided on an upstream side of said image forming unit, for placing stacked recording sheets of paper through a prescribed space in the said apparatus body from outside said apparatus body;

a sheet feeding unit, provided on a further upstream side of said recording sheet accommodating unit in a direction of transporting the recording sheets, for accommodating stacked recording sheets of paper, said sheet feeding unit being provided detachably from said apparatus body;

a transporting passage for guiding the recording sheet of paper fed from said sheet feeding unit to said image forming unit; and a part of said transporting passage formed in said recording sheet accommodating unit, wherein said recording sheet accommodating unit is movable so that at least a part of said transporting passage is opened though a prescribed space in said apparatus body apparatus body.

11. The image forming apparatus according to claim 10, wherein said recording sheet accommodating unit is slidably movable on the same side as that of placing stacked sheets of paper through a prescribed space in said apparatus body from outside said apparatus body.

12. The image forming apparatus according to claim 10, wherein the side of placing the stacked recording sheets of paper is the same as that of detaching said sheet feeding unit from said apparatus body.

13. The image forming apparatus according to claim 10, wherein said apparatus body further includes a sheet exhaust unit for exhausting a recording sheet containing an image formed by said image forming unit externally from said apparatus body; said image forming unit is provided removably from said apparatus body; and detaching/attaching of the image forming unit, exhaust of the recording sheet, placing of the stacked recording sheets on said recording sheet accommodating unit and detaching of said sheet feeding unit from said apparatus body are carried out on the front side of said apparatus body.

14. The image forming apparatus according to claim 10, wherein said apparatus body includes means for transporting the recording sheets accommodated in said recording sheet accommodating unit and said sheet feeding unit to said image forming unit, and at least a part of said transporting means is movable slidably with said recording sheet accommodating unit.

15. The image forming apparatus according to claim 10, wherein latching means for latching said recording sheet accommodating unit at a prescribed position of said apparatus body is provided between said apparatus body and said recording sheet accommodating unit.

16. The image forming apparatus according to claim 11, wherein said apparatus body includes a stopper for limiting slidable movement of said recording sheet accommodating unit to a prescribed position to which said recording sheet accommodating unit is pulled out.

17. The image forming apparatus according to claim 11, wherein said apparatus body includes a stopper for limiting slidable movement of said recording sheet accommodating unit to a prescribed position to which said recording sheet accommodating unit is pulled out, and said recording sheet accommodating unit includes detecting means for detecting presence or absence or remaining amount of the recording sheets in said sheet feeding unit in a manner of being brought into contact with the recording sheets or piece moving with reduction of the amount of the recording sheets, and said detecting means is provided at a position where it is in contact with only the recording sheets or the piece while slidable movement of said recording sheet accommodating unit is limited by said stopper.

18. A unit which is installed removably from an apparatus body, said unit comprising:

a recording sheet accommodating section on which stacked recording sheets of paper are placed;

a driven section provided in the vicinity of said recording sheet accommodating section; and driving force transmitting means for transmitting a driving force from said apparatus body to said driven section, wherein said unit is installed in a manner that at least front end portions of the recording sheets placed on said recording sheet accommodating section in a sheet feeding direction are positioned within said apparatus body wherein said unit further compresses electrically connecting means and wherein said unit is installed to said apparatus body so that said unit and said apparatus body are electrically connected to each other by said electrically connecting means.

* * * * *

UNITED STATES PATENT AND TRADEMARK OFFICE

CERTIFICATE OF CORRECTION

PATENT NO. : 6,145,832
DATED : November 14, 2000
INVENTOR(S) : Yasuhide Saito et al.

It is certified that error appears in the above-identified patent and that said Letters Patent is hereby corrected as shown below:

Column 12, claim 10,
Line 51, "in said" should read -- of said --.
Line 52, after "body", delete "apparatus body".

Signed and Sealed this

Second Day of April, 2002

*Attest:*

*Attesting Officer*

JAMES E. ROGAN
*Director of the United States Patent and Trademark Office*